US006080052A

United States Patent [19]

Renter et al.

[11] Patent Number: 6,080,052

[45] Date of Patent: Jun. 27, 2000

[54] MACHINE FOR FINISHING NONMAGNETIC COMPONENTS

[75] Inventors: Juan Gaig Renter, Berenguer III, 93-95, 08100 Mollet Del Vallés (Barcelona); Jose Gimenez Vidal; Javier Gaig Gomez, both of Mollet del Vallés, all of Spain

[73] Assignee: Juan Gaig Renter, Barcelona, Spain

[21] Appl. No.: 09/186,709

[22] Filed: Nov. 5, 1998

[30] Foreign Application Priority Data

Nov. 6, 1997 [ES] Spain ..... 9702304
Oct. 16, 1998 [ES] Spain ..... 9802152

[51] Int. Cl.[7] ..... B24B 31/00

[52] U.S. Cl. ..... 451/326; 451/327; 451/328

[58] Field of Search ..... 451/32, 326, 327, 451/328, 329, 74, 113, 104

[56] References Cited

U.S. PATENT DOCUMENTS 4,175,930 11/1979 Sakuleich et al. ..... 451/28
4,599,826 7/1986 Podoprigora ..... 451/177
5,044,128 9/1991 Nakano ..... 451/32
5,419,735 5/1995 Imahashi ..... 451/113
5,611,725 3/1997 Imahashi ..... 451/104

*Primary Examiner*—Derris Holt Banks
*Attorney, Agent, or Firm*—Ostrolenk, Faber, Gerb & Soffen, LLP

[57] ABSTRACT

On a conventional chassis (10) forming a rigid structure there is mounted an electromotor (12) whose rotary shaft is coupled to a reducer (13) whose output end (14) is secured via suitable means to a flat (23); on this chassis (10) there is a stationary cylinder (15) on whose lateral surface (15*a*) there are magnets (16–17); inside (15) there is tank (18) which rotates through the action of the shaft of the reducer (13), small flanges (30) being located on the end wall (18*a*) of (18), a support (25) with arms (24), from which iron chains (32) hang, being arranged on the threaded column (27), the machine being intended for the polishing and cleaning of nonmagnetic materials of the type used in jewelry, such as gold, silver, alloys thereof and the like.

15 Claims, 5 Drawing Sheets

10
11
12
13
14
15
16
17
18
18a
18b
19
20
21
23
25
26
26a
27
28
29
31a
32
32
33
34
34

MACHINE FOR FINISHING NONMAGNETIC COMPONENTS

The present application for a patent of invention consists, as set forth, of a "MACHINE FOR FINISHING NONMAGNETIC COMPONENTS" whose novel characteristics of construction, shape, design and performance fulfill the purpose for which it has been specifically designed, with maximum safety and efficiency.

Electromagnetism is understood to mean the magnetism produced by an electric current and also (by electromagnetism) that part of electricity which jointly covers the electrical and magnetic phenomena, joining in a synthesis in which the passage of current is interrelated with said magnetic phenomena.

There is on the market, and therefore they may be regarded as prior art, a variety of machines whose function is to polish and clean nonmagnetic materials, of the type used in jewelry, such as gold, silver, alloys thereof and the like, which are placed in a volume of substantially cylindrical shape in the form of a static chamber or tank, being subjected to a magnetic field as a consequence of the rotation, at its lower part outside said volume, of a rotary dish, which incorporates permanent magnets, said dish being able to rotate in two directions.

Said operations are carried out by virtue of the placing, in the lower part outside said base of said chamber and on a rotary plate, of permanent magnets which cause small magnetic cylinders of stainless steel or a similar material to rotate which, in combination with liquids with specific characteristics, give rise to the double function of cleaning and polishing components placed in said chamber, when said cylinders impact against the surface of the nonmagnetic components placed inside it.

Nevertheless, owing to the constructional characteristics of said machines and as a consequence of an angular movement which said dish makes, all the components placed inside the chamber have a certain tendency to migrate to the vicinity of the perimeter of the chamber, but without reaching it as a consequence of the mass of the components to be treated being greater than that of the cylinders, with the result that there is a very considerable loss of performance in said operations. Experience shows that it is possible to place in such machines only a very low maximum of noble materials to be cleaned and polished, and that, over and above such quantities, these remain stationary as a consequence of the effects of the aforementioned centrifugal forces which have an effect both on the components to be treated and on the cylinders, the result being that the machine fulfills only the cleaning operation.

The subject of the present invention is a substantial modification to said machines and to the systems or processes according to which the machines work, in the sense that the existing machine is redesigned, creating a new machine composed basically of:

a chassis equipped with a back-geared motor;

a cylindrical support on which the corresponding magnets are mounted, said support being secured to said chassis;

a cylindrical tank driven by said back-geared motor rotating inside said cylindrical support.

Therefore, and as a consequence of the greater effectiveness of the magnetic field generated by said magnets, a difference in speeds is established between the magnetic stainless-steel cylinders, which are positioned by said magnetic field in relation to the centrifugal force which drives them toward their perimeter, and the speed imparted by said rotary tank to the components and nonmagnetic mass located inside the tank.

The principle underlying the system whereby the proposed machine functions is that of the static magnetic field produced by electromagnets, or permanent magnets, and the rotation at the most appropriate peripheral speed of the tank containing the magnetic mass and of the nonmagnetic components in a liquid medium, to which small components of an abrasive type in the form of nonmagnetic triangles and cylinders are added.

The function of the magnetic field in this invention is conveniently to keep back the magnetic mass contained in the rotary tank which at the same time by means of centrifugal force carries the nonmagnetic mass and components in a liquid medium which has been prepared to facilitate, in each case, the desired action on the components being processed.

The retention of the magnetic mass gives rise to a turbulence in the nonmagnetic components and mass, unexpected results being obtained in the process, such as the polishing, burnishing and cleaning of the components located inside the tank, all this as a consequence of the turbulence and of the friction caused by the difference in speeds between the nonmagnetic mass and the nonmagnetic components to be treated and nonmagnetic abrasives which surround the components.

The speed of rotation of the tank must be optimum for the type of components to be processed and may be unique for a specific diameter of the tank, since the peripheral speed determines the centrifugal force which is required. The incorporation of an adjustable system with speed variation allows the system to use tanks of different diameters and also allows greater control of the degree of finishing for different types of components, as a function of the intrinsic nature of the components.

With the change in location of the magnets compared to those embodiments which may be regarded as prior art, and given that they are stationary, instead of rotating beneath the tank, a machine is achieved for finishing nonmagnetic metal surfaces which carries out the aforesaid operations, such as polishing, burnishing and cleaning, in a genuinely surprising manner, using, in order to achieve such results, liquids of different densities, as well as abrasive powder and granulate which is distributed between the nonmagnetic masses (cylinders, spheres or other shapes), producing an abrasive action which assists in improving the aforesaid functions.

To optimize the machine's yield, the speed of rotation of the tank is controlled by means of a reducer coupled to the output of an electric motor, which makes it possible to coordinate the speed of rotation of the components placed inside said tank on the basis of weight, dimensions, configurations and materials from which they are made and the nature of the liquid introduced, with the result that the performance achieved in said machine retains its level of efficiency in relation to said weight, dimensions and nature of the materials placed inside the tank without a limitation of the load in machines which exist on the market.

The central, striated support of the tank slides over the keyed shaft of the motor/reducer vertical axis and may, once stopped, be inserted and removed conveniently for rinsing or emptying the tank.

The rotation of the tank may be transmitted by coupling it directly to the vertical shaft of a motor but, as the speeds of rotation required are not high, it is better to do this via a reduction which imparts greater rotary force to the shaft and the power and size of the motor are smaller, which considerably reduces the size of the machine.

To facilitate the fitting and removal of the tank, a central, striated bush has been designed which slides over the keyed shaft of the back-geared motor's vertical axis and may, once stopped, be inserted and removed conveniently for rinsing or emptying the tank, a cylindrical housing with internal thread having been machined on its upper part so that it is possible to screw on the corresponding cover and to keep the tank closed once the corresponding components, cylinders and liquids have been placed inside it.

The magnetic fields which the magnets produce remain static and strategically surround the environment of the rotary tank, an iron flat having been provided to avoid the loss of field via the outer part of the environment or cylinder which contains the magnets, leaving a minimum space between the tank and the stationary cylinder which accommodates them.

Another, additional aim of the present invention relates to improvements made to the subject of the main patent and which are based on the modification of the arrangement of the elements found inside the machine's tank, in which nonmagnetic components are finished. Said modifications consist in the insertion inside said tank of a plate with radial arms from which corresponding iron chains hang, whose aim is to modify the state of movement of the components placed inside the tank, with a view to increasing the yield of the finishing operation, as will be explained in detail below.

In the prior art patent of the same titleholder, P9702304 (3), a description and claims are given which concern a machine for finishing nonmagnetic components, "finishing" being understood to mean processes of refining, polishing, brightening and cleaning the surfaces of components of nonmagnetic materials, such as gold, silver, brass, copper, plastics, minerals and the like, which includes a chassis equipped at its lower part with a back-geared motor, a cylindrical support secured to said chassis, in which the corresponding magnets are mounted, secured to said support, a cylindrical tank driven by the back-geared motor rotating inside the cylindrical support and covered with the corresponding casing, whose functioning and work process are based on using the force of the magnetic field produced by electromagnets or permanent magnets in combination with the rotation at the most appropriate-angular speed of a magnetic metal mass mixed with nonmagnetic mass and components in a liquid medium; the nonmagnetic mass corresponds to the components to be finished and to small components of an abrasive nature in the form of triangles and cylinders and any other known shape.

The processes which are carried out inside the rotary tank of the machine may be processes which are known as wet or dry.

For any of the finishing processes, there must always be, inside the tank, magnetic particles which may have any shape (small rods, chain, balls, etc.) and which are retained by the magnetic action of the magnets at the points mentioned against the moving walls of the rotary tank. There will also be, inside the tank for each type of process, whether this is wet or dry, the more or less abrasive nonmagnetic mass for carrying out the desired process, in the form of granulate of an appropriate form and size. The nonmagnetic mass is what acts on the nonmagnetic components.

The nonmagnetic components whose surfaces are to be processed are placed inside the tank together with the nonmagnetic mass described. The centrifugal force generated inside the rotary tank causes the nonmagnetic mass, together with the nonmagnetic components which it is desired to process, to travel at the speed of the tank which contains them and, owing to the interference of the magnetic particles retained, turbulence is produced at these points, which generates differences in speed between the nonmagnetic mass and the components to be processed, the desired action on the surface of the components thereby being achieved.

The retention of the magnetic mass gives rise to a turbulence in the nonmagnetic components and mass, unexpected results being obtained in the finishing process such as the polishing, burnishing and cleaning of the components located inside the tank, all this as a consequence of the turbulence and of the friction caused by the difference in speeds between the nonmagnetic mass and the nonmagnetic components to be treated and nonmagnetic abrasives which surround the components. All this is as described on p. 4 of said specification.

The construction, manufacture and implementation of the machines which are the subject of the main patent have shown that, although the expectations and the design of the machine have been achieved with the expected yield, there are parts of the machine which can be improved, this contributing to an increase in said yield.

The improvements made to the proposed machine consist of the fitting of an upper support located free on the shaft of the tank from which the corresponding iron chains hang.

The configuration of the support, as will be described below, has a series of arms extending in a radial manner transversely of said support, at whose ends the corresponding iron chains are fitted, these hanging vertically from said arms and being located inside the tank of the machine and held against its wall by external magnetic attraction.

The functioning of the machine as explained above is based on the rotation of the nonmagnetic components and masses to be finished, mixed with liquid or paraliquid or dry media inside its tank, which, upon rotation and as a consequence of the centrifugal force generated, forces said masses against the wall of the tank.

In experiments carried out with the machine which is the subject of the main patent, it was observed that the excess mass (magnetic products and nonmagnetic components) breaks the magnetic field generated by the magnets and the mass of products to be polished and the elements such as small rods and stars form a pile, this being no more than the consequence of said excess mass or, rather, of an inadequate speed, said masses being forced completely against said lateral surface, and for this reason the present modifications have been introduced to help prevent said phenomenon occurring since, in some cases, and despite the fact that the instructions for the actual machine specify the most suitable speeds and masses for each type of components to be treated, it is fairly difficult for the user in some cases to measure said speeds and masses and to detect whether the limit values established for optimum functioning of the machine and for achieving the desired yields have been exceeded by a small amount.

Another of the additional improvements of the present invention is that of replacing the methacrylate tank with its casing by another manufactured from thinner stainless steel (1 mm) covered with a 3-mm antifriction jacket with the result that the overall thickness is reduced and the passage of the magnetic flow is facilitated, thereby increasing the force of retention of the magnetic mass inside the tank, which contributes to its not losing so much intensity as a consequence of the presence of said jacket and its casing, with the result that the machine gains in terms of effectiveness because the magnetic field, inside the tank, is of greater magnitude than in the original machine.

Further additional improvements in the present invention consist of the placing of stationary magnets (first magnet means) at the lower part of the end wall a bottom of the tank defining a first plane, with the result that the iron chains which hang from the proposed support are forced to remain in a vertical position, preventing, by their presence, the piling-up of the masses and components to be treated which in some cases used to become attached to the wall and which, now, with the presence of the iron chains, do not reach the wall and continue their angular movement via the base of the tank, encircling said magnets.

Further details and characteristics of the present application for a patent of invention will become apparent in the course of the description which is given below, in which reference is made to the drawing accompanying this specification in which, somewhat diagrammatically, the preferred details are shown. These details are given by way of example, referring to a possible practical embodiment, but it is not restricted to the details which are given here. Therefore, this description must be regarded as illustrative and without limitations of any type.

We shall now give a list of the various numbered elements in the drawing appended to the present specification: (10) chassis, (11) legs, (12) electromotor, (13) reducer, (14) mouth or output end, (15) external cylinder or outer sleeve having an inner surface, (16) magnets, (17) magnets, (18) tank, **(18*a*) end or bottom wall of the tank (18), (18*b*) inner lateral surface of the tank (18), (19) iron flat, (20) screws, (21) shaft of the reducer (13), (23) iron flat, (24) arms, (25) support, (26) striated bush, (26*a*) chamfered zone, (27) threaded column, (28) nut, (29) cover, (31*a*) seat on the zone (26*a*), (32) iron chains, (33) jacket, (34) magnets or first magnet means. Said tank 18** is defined by its sidewalls with outer surfaces which are adjacent said inner surfaces of said outer sleeve.

It is pointed out that the machine which is the subject of the present invention may be made more versatile and efficient by the incorporation of a rotary-speed regulator and adjustable-magnetic-field electromagnets.

Figure 1:
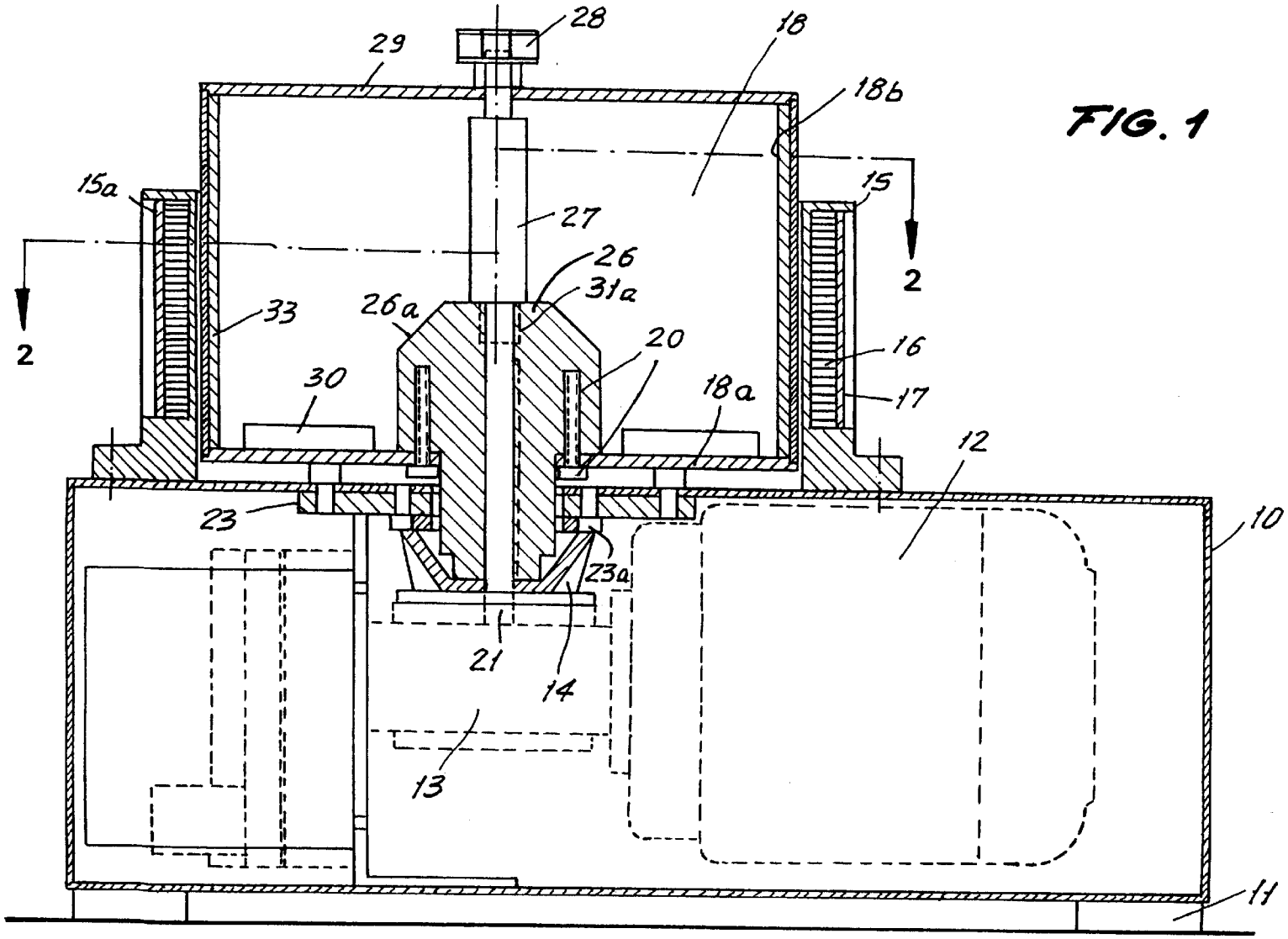
FIG. 1 is a diagrammatic cross section in elevation of the proposed machine, with motor/reducer (12–13) and the random arrangement of various permanent magnets.

In one of the preferred embodiments of what is the subject of the present patent of invention, and as may be seen in FIG. 1, the proposed machine is formed by a chassis (10) constructed on the basis of a group of horizontal or vertical rails, welded together and equipped (10) with legs (11), forming a rigid structure in which the various parts of the machine are fitted, such as a conventional electromotor (12), whose rotary shaft is coupled to a reducer (13), whose mouth or output end (14) is secured by appropriate means to the flat or platform (23), by means of the screws **(23*a*) which screw into the drill holes (23*b*) provided on said flat (23)**.

The tank (18) is formed by an open cylinder without an upper end wall and whose lower end or wall **(18*a*) and in its central part is occupied by a striated bush (26–26*a*) which both serves as a support element for a column (27) which is threaded at both ends, its lower end threading into the seat (31*a*) and the upper end of the column into the nut (28), the column passing through a small disc or cover (29), located on the nonexistent end wall of said tank (18) and makes it possible to remove the components to be treated which have been placed inside (18)** when the polishing, cleaning and other similar operations commence.

On the base of the machine (see FIGS. 2 and 3) are mounted, via suitable means, fastening screws or the like, an outer cylinder (15) without upper and lower end walls, which serves as a support element for the corresponding magnets (16) and (17) located on its lateral surface **(15*a*)**.

The tank (18) is located inside the outer cylinder (15), the striated bush (26) being coupled to the shaft (21) of the reducer (13), via the seat **(31*a*)**, by means of gravity.

As explained above, in the prior art, the magnets located at the base of the machine and in the lower, outer part of the tank (18) have been removed, while in the machine which is the subject of the invention the magnets located in the outer cylinder (15) and on its lateral surface **(15*a*) have been considerably enlarged, being able to occupy practically the entire height of (15*a*), and also within one and the same level one magnet (16–17) has been placed on another, with the result that the working limit of the magnetic cylinders placed inside the tank (18)** together with pieces of abrasive and the components to be treated is increased.

To the same end, i.e. that of increasing the performance of said magnets or second magnet means (16–17), an iron plate (19) is fitted (see FIG. 2) at the rear part thereof so that the magnetic field generated by them is increased considerably when the magnetic force generated turns forward, i.e. toward the shaft (21) of the tank (18), with the result that the magnetic metal cylinders are obliged to be attracted with greater force through the increase gained in the magnetic field, with the result that an increase in yield of 30% is achieved compared to machines which form part of the prior art in which the magnets are arranged in the base of the machine parallel to the end wall **(18*a*)** of the tank.

Figure 2:
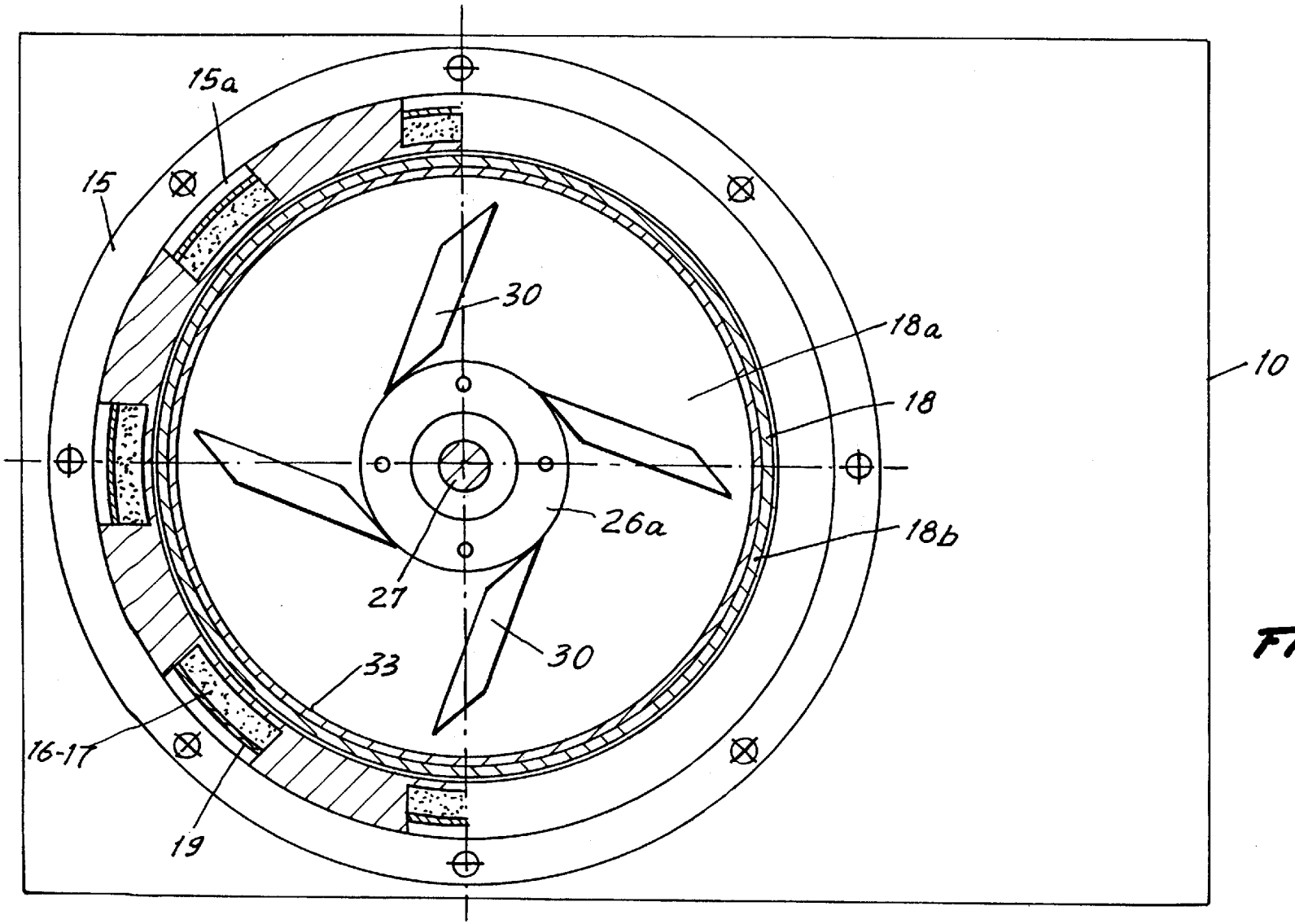
FIG. 2 is a diagrammatic upper plan view of the tank (18).
Figure 3:
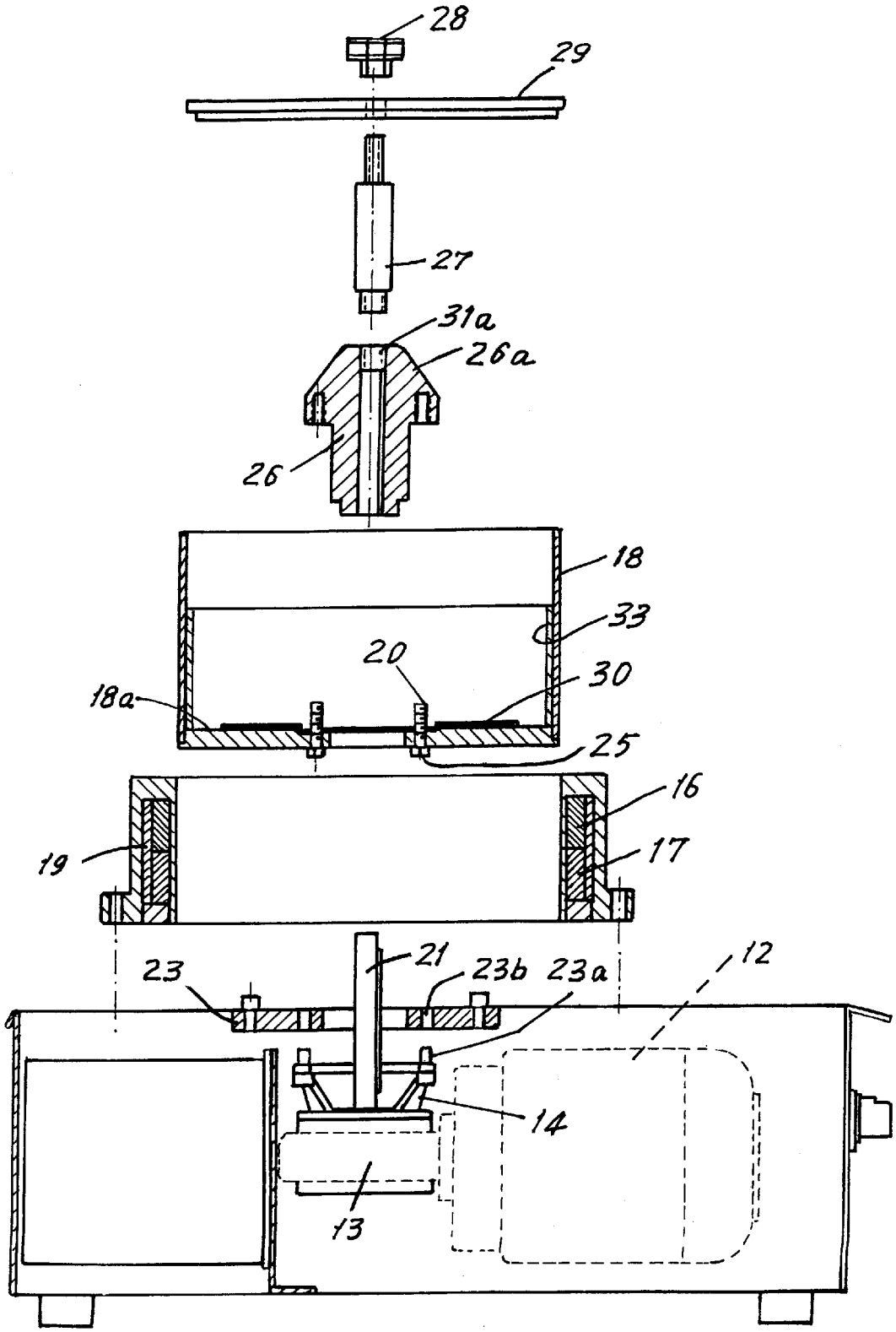
FIG. 3 is an exploded front view in elevation of the machine.

The different positioning of the magnets (16–17) which are circumferentially spaced about central axis x—x defining a circular band as seen as FIGS. 1 and 2 and the fitting of a double layer and level of magnets in the outer cylinder (15) cause the metal cylinders or small rods to be forced completely against the inner lateral surface **(18*a*) of the tank (18), forming a hedgehog-like surface, so that they counteract the movement of the pieces of jewelry placed inside the tank (18)** and impelled by the centrifugal force against said hedgehog-like surface, causing them to be polished, burnished and cleaned in combination with the liquids placed inside the tank.

To the same end, i.e. to increase the movement of the pieces of jewelry placed inside the tank (18), a set of blades or of small flanges (30) have been distributed uniformly and in the end wall **(18*a*) of the tank, these blades obliging said components not to remain immobilized on the end wall (18*a*) of the tank as a result of their own weight but, as a consequence of the angular movement, and as they arrive impelled by the centrifugal force on said flanges (30), said components commence a sort of tumbling action until they collide with the metal small rods or cylinders which are held while the lateral surface (18*a*) of the tank (18) rotates, thereby serving as a means for overcoming the inertia of the components at the moment the motor (12) is started and the shaft (21)** moves.

As a consequence of the location of the magnets (16–17) on the lateral surface **(15*a*) of the outer cylinder (15), it has been seen in experiments that the small metal cylinders, through the action on them of the magnetic force generated by (16–17), remain as columns on the inside of the surface (18***a*) so that the impact between the components thrown upward by the flanges (30) gives rise to the scraping of the surface of said components, but not the pitting of their surface, known in this technical area as "peening", which, seen under a magnifying glass, can be observed as a series of points on said components which are like deformations thereon, which is one of the hitherto most marked drawbacks of the existing machines on the market.

As a consequence of the high yield achieved and in order to prevent the possibility of the lateral surface (18*a*) of the tank suffering any type of premature wear, a jacket made from an antifriction material (33) is placed inside it (see FIG. 1).

Also with the aim of improving the machine's performance, i.e. allowing the maximum movement of the components placed inside the tank (18), the central part of the tank (18), i.e. the bush (26), has been designed to be slightly conical and its upper end wall forms a chamfered zone (26*a*).

Figure 4:
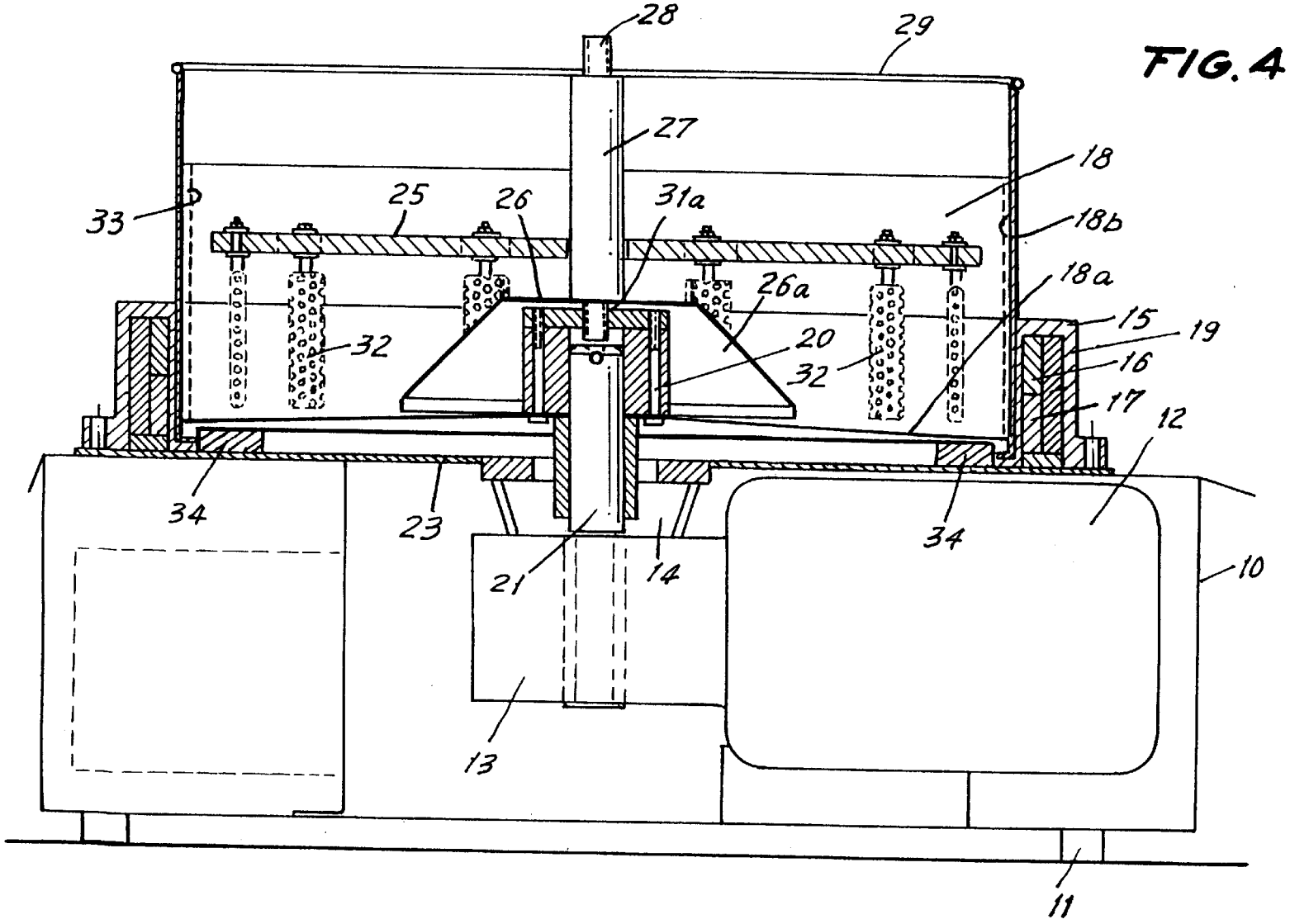
FIG. 4 is a front view in elevation of a longitudinal section of the improved machine in which it is possible to see the arrangement of the support (25) located on the column (27) of the machine, from which the corresponding iron chains (32) hang.
Figure 5:
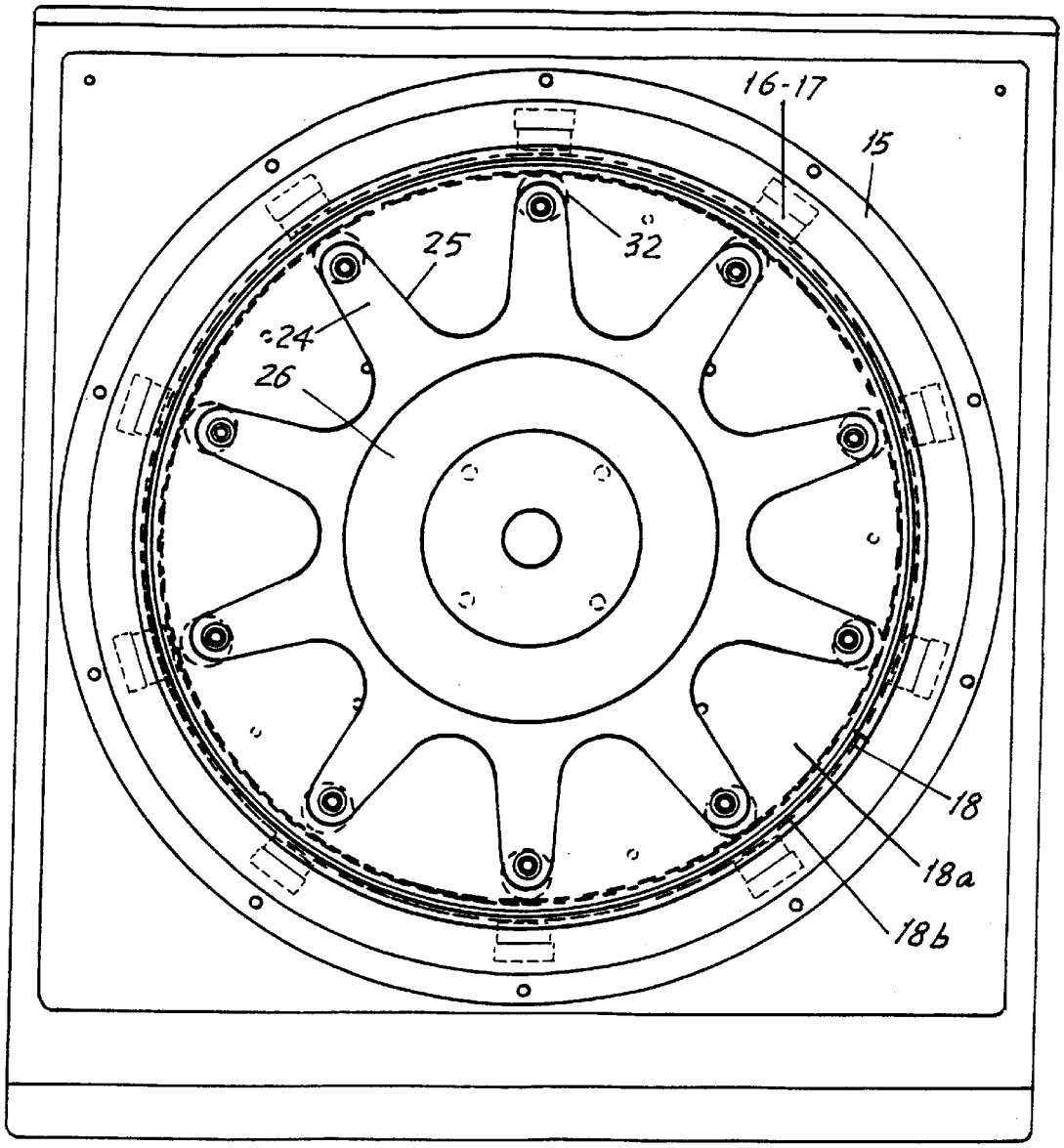
FIG. 5 is an upper plan view in which it is possible to see the formal characteristics of the star-shaped support (25) with arms (24).

In one of the preferred embodiments of that which is the subject of the present patent of invention, and as may be seen in FIG. 4, the support (25) has been placed on the column (27), in the operating state of the machine where column 27 is generally vertical and normal to the plane defined by said first magnet means; said support (25) will remain stationary and its radially arranged transversely extending arms (24) serve as support means for iron chains (32) which are placed at the ends of the arms and are opposite the corresponding magnets (16–17) arranged in the body of the machine and in its outer cylinder (15), so that the combination of the magnetic field generated by these magnets (first magnet means) and by others (34) located in the lower part of the tank (18) forces said iron chains (32) to maintain a vertical position, forming an obstacle located parallel to the lateral surface of the tank (18) and that of the casing (33), held on said surface of (18) through the action of the magnetic force of the magnets (16–17), and makes it difficult for the treatment mass and the mass of products to be treated to remain against said lateral surface through the action of an excess of weight or of speed, then forcing said masses to describe a forward movement directed toward the center of the machine encircling the iron chains (32), which improves the turbulence movement and the rotational movement of said mass on itself, which is the phenomenon which in turn makes it possible to increase the performance of polishing and finishing the components. FIG. 4 shows the magnet 34 as a ring situated near and inward of the tank's side wall 18*b*.

Another of the additional improvements of the present invention consists in replacing the methacrylate tank (18), which in the main patent required covering with the corresponding casing (33), by another tank (18) manufactured from stainless steel, with a two-directional end wall (18*a*) and whose thickness will be approximately 1 mm, which, in combination with the thickness of the casing of some 3 mm, will mean that the total thickness that the magnet field produced by the magnets located in the carcass of the machine will have to cross is reduced from 6 to 4 mm, with the result that the magnitude of the magnetic field created will be increased, promoting the action on the magnetic mass located inside (18). FIG. 4 shows end wall 18*a* sloping from the center downward in the radially outward direction.

The combination of an increase in the turbulence generated by the iron chains (32) which remain vertical and against the surface of the jacket (33) and the increase in the magnetic field produces an increase in the performance of the treatment of the nonmagnetic components placed inside the tank (18) for finishing.

Improvements which, by modifying the formal characteristics of the support (25) with radial arms (24) in the form of a star, permit the suspension of elements such as iron chains, sheets, wires or the like, and whose aim is to prevent the agglomeration of the components placed inside when these are treated and subjected to an angular speed through rotation of the tank (18), will be regarded as equivalent to those proposed in the present invention.

The content of the present patent having been sufficiently described with reference to the appended drawings, it will be understood that any modifications of detail which are considered appropriate may be introduced into it provided the proposed variations do not alter the essential nature of the patent which is summarized in the following claims.

What is claimed is:

1. A machine for finishing nonmagnetic components which are placed together with a plurality of magnetic components and rotated creating a centrifugal force on said magnetic and nonmagnetic components in said machine, said machine comprising a. a chassis, b. a tank having a bottom and side walls, said tank mounted rotatably on said chassis, c. impulsion means mounted to said chassis and coupled to said tank for rotating said tank, d. first magnet means mounted to said chassis and situated below said bottom wall of said tank, e. an outer sleeve mounted to said chassis, said outer sleeve having cylindrical walls which at least partially surround said tank side walls, and f. second magnet means situated at regular intervals circumferentially around said outer sleeve and fixed thereto, said first and second magnet means cooperating to create a magnetic field within said tank, whereby upon rotation of said tank said plurality of nonmagnetic components therein are driven radially outwardly by said centrifugal force toward said side walls of said tank, and said plurality of magnetic components are driven similarly radially outwardly by said centrifugal force and are restrained from said movement by said magnetic field so as to cause said nonmagnetic components to move at different speeds than that of said magnetic components and to create a turbulent motion within said tank of said nonmagnetic components.

2. Apparatus according to claim 1 wherein said impulsion means comprises an electric motor having an output shaft coupled to said tank for rotating same.

3. Apparatus according to claim 2 further comprising a striated bush coupling said output shaft with said tank.

4. Apparatus according to claim 3 wherein said second magnet means further comprises a second set of magnets similar to said first set and having the same diameter and coaxial therewith and spaced farther from said first plane than said first set.

5. Apparatus according to claim 4 further comprising an iron plate situated adjacent and radially outward of each of said second magnet means.

6. Apparatus according to claim 1 wherein said tank further comprises a plurality of flanges extending generally upward from said bottom wall of said tank and radially outward, said flanges directing said nonmagnetic components subjected to centrifugal forces to move in a turbulent motion.

7. Apparatus according to claim 1 wherein said first magnet means define a first plane generally parallel to said bottom wall of said tank, and said second magnet means comprises a first set of circumferentially spaced magnets defining a circular band whose central axis is perpendicular to said first plane and is situated a first distance upward from said first plane.

8. Apparatus according to claim 1 further comprising an iron plate situated adjacent and radially outward of each of said second magnet means.

9. Apparatus according to claim 1 wherein said outer sleeve has an inner surface facing the outer surface of said tank, said apparatus further comprising an antifriction layer on said outer surface of said tank side walls and adjacent said inner surface of said outer sleeve.

10. Apparatus according to claim 1 further comprising a support extending from said chassis to a position above said bottom wall of said tank, at least one arm extending transversely from said support to a position in said tank and above said bottom surface of said tank, and at least one chain hanging downward from said at least one arm toward said bottom wall of said tank, said chain comprising iron and thereby held by said magnetic field established by said first and second magnet means to tend to hang generally vertically despite the transverse movement of said nonmagnetic components engaging said at least one chain in said tank.

11. Apparatus according to claim 1 further comprising a support extending from said chassis to a position above said bottom wall of said tank, at least one arm extending transversely from said support to a position in said tank and above said bottom surface of said tank, and a plurality of chains hanging downward from said at least one arm toward said bottom wall of said tank, each of said chains comprising iron and situated generally adjacent the inside surface of said side wall of said tank and generally adjacent one of said second magnet means and thereby attracted to lie against said side wall by said magnetic field established by said second magnet means, said chains serving as obstacles to cause turbulent movement of said nonmagnetic components as they engage said chains as said tank rotates.

12. Apparatus according to claim 1 wherein said bottom wall of said tank slopes downward from the center thereof radially outward.

13. Apparatus according to claim 1 wherein said first magnet means comprises a circular ring situated in said chassis beneath the bottom wall of said tank.

14. Apparatus according to claim 1 wherein said magnetic components comprise rods or balls.

15. A machine for finishing nonmagnetic components which are placed together with a plurality of magnetic components and rotated creating a centrifugal force on said magnetic and non-magnetic components in said machine, said machine comprising a. a chassis, b. a tank having a bottom and side walls, said tank mounted rotatably on said chassis, c. an electric motor mounted to said chassis and coupled to said tank for rotating said tank, d. first magnet means mounted to said chassis and situated below said bottom wall of said tank generally near and inward of said side walls thereof and creating a first magnetic field within said tank, e. an outer sleeve mounted to said chassis, said outer sleeve having cylindrical walls which at least partially surround said tank side walls, f. second magnet means situated at regular intervals circumferentially around said outer sleeve and mounted thereto, and creating a second magnetic field within said tank, and g. a support extending from said chassis to a position above said bottom wall of said tank, at least one arm extending transversely from said support to a position in said tank and above said bottom surface of said tank, and a plurality of chains hanging downward from said at least one arm toward said bottom wall of said tank, each of said chains comprising iron and situated generally adjacent the inside surface of said side walls of said tank and generally adjacent one of said second magnet means and thereby attracted to lie against said side walls by said magnetic field established by said second magnet means, whereby upon rotation of said tank said plurality of nonmagnetic components therein are driven radially outwardly by said centrifugal force toward said side walls of said tank, and said plurality of magnetic components are driven similarly radially outwardly by said centrifugal force and are restrained from said movement by said chains serving as obstacles causing turbulent movement of said nonmagnetic components as they engage said chains as said tank rotates.

* * * * *